United States Patent [19]

Chan

[11] Patent Number: 4,684,880

[45] Date of Patent: Aug. 4, 1987

[54] REFERENCE CURRENT GENERATOR CIRCUIT

[75] Inventor: Daniel F. Chan, Huntington Beach, Calif.

[73] Assignee: TRW Inc., Redondo Beach, Calif.

[21] Appl. No.: 939,848

[22] Filed: Dec. 9, 1986

[51] Int. Cl.[4] ..... G05F 3/16

[52] U.S. Cl. ..... 323/316; 307/455

[58] Field of Search ..... 323/312–316, 323/907; 307/455, 296 R, 297, 310

[56] References Cited

U.S. PATENT DOCUMENTS 4,302,719 11/1981 Mattfeld ..... 323/316

4,629,913 12/1986 Lechner ..... 307/455 X 4,644,194 2/1987 Birrittella et al. ..... 323/315 X

*Primary Examiner*—Peter S. Wong

*Attorney, Agent, or Firm*—Noel F. Heal

[57] ABSTRACT

A reference current generator circuit for generating a reference current $I_R$ that is independent of variations in the base-to-emitter junction voltages $V_{BE}$ of the transistors in the generator circuit. Applying the reference current $I_R$ to a current source transistor $Q_{CS}$ in a CML circuit generates a collector current $I_O$, output by the current source transistor $Q_{CS}$, that is independent of the variations in the base-to-emitter junction voltages $V_{BE}$ of both circuits. This produces a CML output voltage $V_O$ that is nearly temperature independent. Combining the reference current generator circuit with a current source transistor provides a constant and stable current source that can be utilized in a variety of electronic circuit applications.

15 Claims, 2 Drawing Figures

REFERENCE CURRENT GENERATOR CIRCUIT

BACKGROUND OF THE INVENTION

This invention relates generally to reference voltage and reference current generator circuits and, more particularly, to reference current generator circuits having improved stability characteristics.

Reference voltage and reference current generator circuits produce constant and stable voltages and currents, respectively, for a variety of electronic circuit applications. A typical electronic circuit application employing a reference voltage generator circuit is current mode logic (CML). CML is a particular type of digital logic circuitry in which the transistors that form the logic gates are switched between the "on" and "off" states without becoming saturated. The transistors are prevented from saturating by limiting the base-to-collector forward junction voltages of the transistors. Because the transistors do not saturate, the switching speed of the transistors and, therefore, the speed of the CML circuit, is greatly increased.

Generally, two types of reference voltage generator circuits have been employed in the past with CML circuits. A reference voltage generator circuit is used in a CML circuit to drive the current source transistors, which supply the currents for the CML logic gate transistors. One type of reference voltage generator circuit used in the past is a simple arrangement of two bipolar transistors. A negative feedback loop extends from the collector of the second transistor, through the base and the emitter of the first transistor, to the base of the second transistor. Unfortunately this reference voltage generator circuit produces a reference voltage having a relatively large temperature coefficient. Furthermore, the currents generated by the current source transistors in a CML circuit are temperature dependent. Because the output voltages of the CML circuit are proportional to the currents supplied by the current source transistors, the output voltages of the CML circuit are also temperature dependent. This temperature dependency of the junction voltages of the CML logic gate transistors, which is aggravated at higher operating temperatures, can cause considerable saturation of the CML transistors. This decreases transistor switching time and, therefore, the speed of the CML circuit.

The second type of reference voltage generator circuit used in the past with CML circuits is a band-gap voltage reference generator circuit. The band-gap voltage reference generator circuit produces a reference voltage that is proportional to the bandgap voltage of silicon, which is approximately 1.23 Volts. The band-gap reference voltage generator circuit exploits both the negative and positive temperature coefficients of bipolar transistors. The temperature coefficient of the base-to-emitter junction voltage $V_{BE}$ of a bipolar transistor is negative, with a value of approximately $-2$ mV/° C. The temperature coefficient of the voltage difference between the base-to-emitter junction voltages $V_{BE}$ of two bipolar transistors operating at different emitter current densities is positive. Combining the negative temperature coefficient of the base-to-emitter junction voltage with the positive temperature coefficient of the voltage difference between the base-to-emitter junction voltages produces a reference voltage having a nearly zero temperature coefficient. A typical band-gap voltage reference generator circuit is described in Hamilton, Douglas J. and Howard, William G., *Basic Integrated Circuit Engineering*, McGraw-Hill, Inc., 1975, at pages 429 to 431. However, ever, the currents generated by the current source transistors in a CML circuit are still temperature dependent and, therefore, the CML output voltages are also still temperature dependent. Accordingly, there has been a need for a reference voltage or reference current generator circuit that compensates for the temperature dependency of the currents generated by the current source transistors in a CML circuit. The present invention clearly fulfills this need.

SUMMARY OF THE INVENTION

The present invention resides in a reference current generator circuit for generating a reference current $I_R$ that is independent of variations in the base-to-emitter junction voltages $V_{BE}$ of the transistors in the generator circuit. In a presently preferred embodiment of the invention, the reference current $I_R$ is applied to a current source transistor $Q_{CS}$ in a CML circuit, thus generating a collector current $I_O$, output by the current source transistor $Q_{CS}$, that is independent of the variations in the base-to-emitter junction voltages of the two circuits. This produces a CML output voltage $V_O$ that is nearly temperature independent. In another presently preferred embodiment of the invention, the reference current generator circuit is combined with a current source transistor to provide a constant and stable current source that can be utilized in a variety of electronic applications.

The reference current generator circuit of the present invention includes a bipolar transistor, a positive or regenerative feedback loop from the collector of the transistor to its emitter, a negative feedback loop from the collector of the transistor to its base, and a resistor that connects the emitter of the transistor to ground. The reference current flow through the resistor is the sum of the current flows through the positive and negative feedback loops. This current flow can be made to be independent of temperature variations, and to other variations in the base-to-emitter junction voltages $V_{BE}$ of the transistors, by matching the magnitudes of the current flows through the positive and negative feedback loops. This is accomplished by properly proportioning the resistance values of several resistors in the generator circuit.

It will be appreciated from the foregoing that the present invention produces a reference current that nearly eliminates the temperature dependency of the output voltage of a CML circuit and, when combined with a current source transistor, provides a constant and stable current source. Other features and advantages of the present invention will become apparent from the following more detailed description, taken in conjunction with the accompanying drawings, which illustrate, by way of example, the principles of the invention.

DESCRIPTION OF THE PREFERRED EMBODIMENTS

Figure 1:
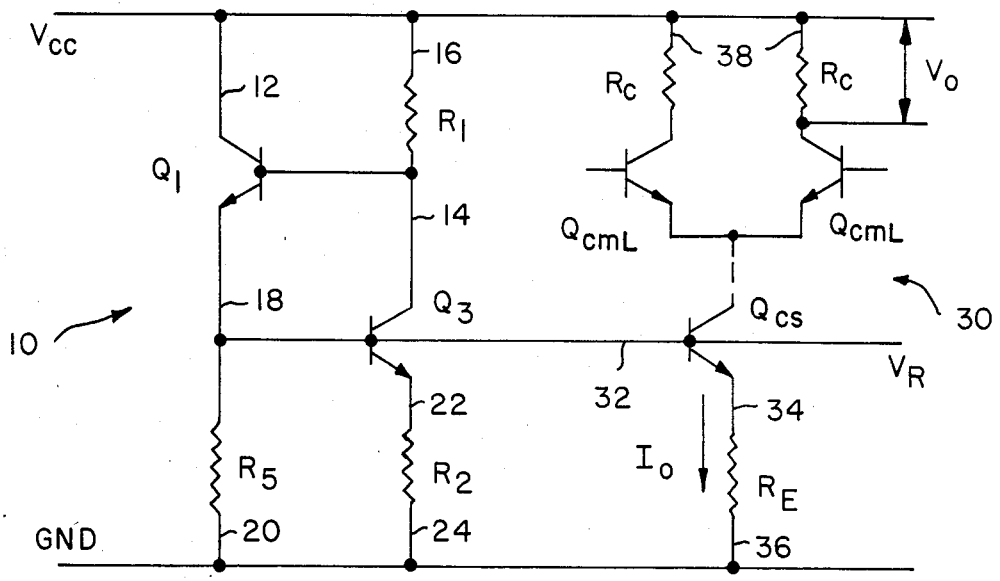
FIG. 1 PRIOR ART
FIG. 1 is a circuit diagram of a prior art reference voltage generator.

As shown in the drawings for purposes of illustration, the present invention is embodied in a reference current generator circuit for generating a reference current $I_R$ that is independent of variations in the base-to-emitter junction voltages $V_{BE}$ of the transistors in the generator circuit. Reference voltage generator circuits have generally been employed in the past with CML circuits. One type of reference voltage generator circuit used in the past is indicated by reference numeral 10 in FIG. 1. The reference voltage generator circuit 10 includes two bipolar transistors $Q_1$ and $Q_3$, arranged in a parallel configuration, and three resistors $R_1$, $R_2$ and $R_5$. The collector of transistor $Q_1$ is connected to a supply voltage $V_{CC}$ by line 12. The collector of transistor $Q_3$ is connected to the base of transistor $Q_1$ and to one terminal of resistor $R_1$ by line 14. The other terminal of resistor $R_1$ is connected to the supply voltage $V_{CC}$ by line 16. The emitter of transistor $Q_1$ is connected to the base of transistor $Q_3$ and to one terminal of resistor $R_5$ by line 18. The other terminal of resistor $R_5$ is connected to ground by line 2O. The emitter of transistor $Q_3$ is connected to one terminal of resistor $R_2$ by line 22. The other terminal of resistor $R_2$ is connected to ground by line 24.

An expression for the reference voltage Vgenerated by reference voltage generator circuit 10 can be derived as follows, assuming the bipolar transistors have the same current density and the base currents of the transistors are negligible.

$$V_R = V_{R2} + V_{BE}$$

where $V_{R2}$ = voltage drop across resistor $R_2$ $V_{BE}$ = voltage of the base-to-emitter junction of the transistors $$= ((V_{CC} - 2V_{BE})*R_2/(R_1 + R_2)) + V_{BE}$$

where $V_{CC}$ = supply voltage

The reference voltage generator circuit 10 drives a current source transistor $Q_{CS}$ in a CML circuit 30. The reference voltage $V_R$ on line 18 is connected to the base of the current source transistor $Q_{CS}$ by line 32. The emitter of the current source transistor $Q_{CS}$ is connected to one terminal of an emitter resistor $R_E$ by line 34. The other terminal of the emitter resistor $R_E$ is connected to ground by line 36. The collector of the current source transistor $Q_{CS}$ is connected to a pair of CML logic gate transistors $Q_{CML}$. The current generated by the current source transistor $Q_{CS}$ is switched by logic applied to the bases of the CML logic gate transistors $Q_{CML}$. The CML transistors are shown in FIG. 1 in a complementary pair configuration and, for convenience, only one pair of the series arrangement of complementary pairs is shown. The collectors of the CML transistors $Q_{CML}$ are each connected to one terminal of a collector resistor $R_C$. The other terminal of each collector resistor $R_C$ is connected to the supply voltage $V_{CC}$ by line 38. An expression for the CML output voltage $V_O$, which is the voltage drop across the collector resistor $R_C$, can be derived as follows.

$$I_O = V_{RE}/R_E = (V_R - V_{BE})/R_E$$

where $I_O$ = collector current of $Q_{CS}$

-continued $V_{RE}$ = voltage drop across resistor $R_E$ $$= ((V_{CC} - 2V_{BE})*R_2/(R_1 + R_2))/R_E$$

$$V_O = I_O*R_C$$

$$= ((V_{CC} - 2V_{BE})*R_2/(R_1 + R_2))*R_C/R_E$$

The base-to-emitter junction voltages $V_{BE}$ of the transistors have a negative percentage change of voltage with temperature (−2 mV/°C.) and, therefore, fore, the CML output voltage $V_O$ as a positive percentage change of voltage with temperature. This means that as temperature increases, the base-to-emitter junction voltage $V_{BE}$ of the $Q_{CS}$ transistor decreases and, since $V_{CC}$ remains constant, the CML output voltage $V_O$ increases. The result is possible saturation of the CML logic gate transistors $Q_{CML}$.

Figure 2:
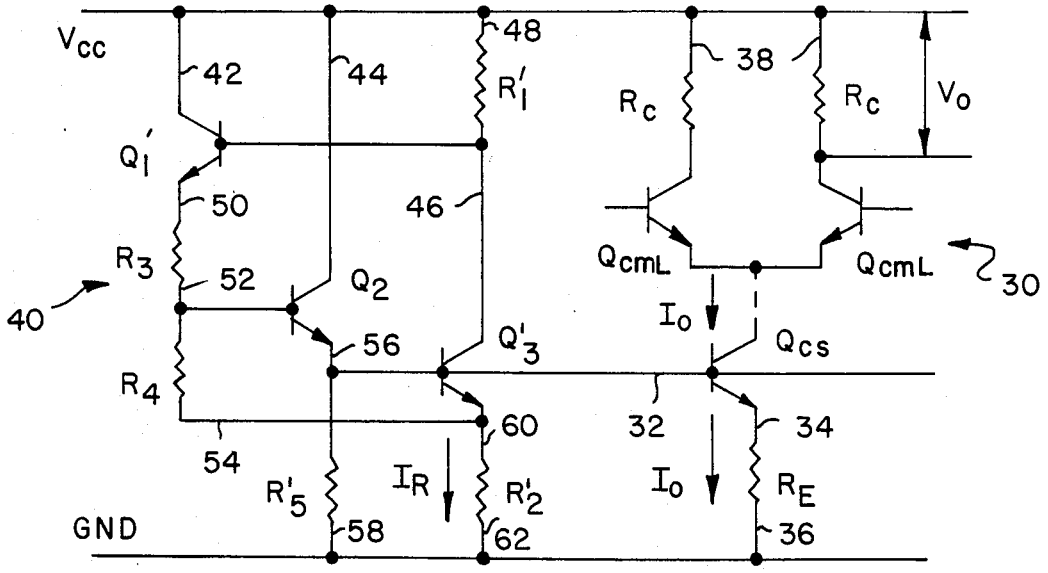
FIG. 2 is a circuit diagram of the reference current generator of the present invention.

In accordance with the present invention, a reference current generator circuit 40, as shown in FIG. 2, generates a reference current $I_R$ that is independent of variations in the base-to-emitter junction voltages $V_{BE}$ of the transistors in the generator circuit 40. In a presently preferred embodiment of the invention, the reference current $I_R$ is applied to the current source transistor $Q_{CS}$ in the CML circuit 30, thus generating a collector current $I_O$, output by the current source transistor $Q_{CS}$, that is independent of the variations in the base-to-emitter junction voltages of the two circuits. This produces a CML output voltage $V_O$ that is nearly temperature independent. The reference current generator circuit 40 relies on the close matching of the base-to-emitter junction voltages $V_{BE}$ of the transistors in the two circuits and, therefore, the transistors are preferably identical transistors formed on a single monolithic substrate.

The reference current generator circuit 40 includes three bipolar transistors $Q_1'$, $Q_2$ and $Q_3'$ arranged in a parallel configuration, and five resistors $R_1'$, $R_2'$, $R_3$, $R_4$ and $R_5'$. The collectors of transistors $Q_1'$ and $Q_2$ are connected to a supply voltage $V_{CC}$ by lines 42, 44, respectively. The collector of transistor $Q_3'$ is connected to the base of transistor $Q_1'$ and to one terminal of resistor $R_1'$ by line 46. The other terminal of resistor $R_1'$ is connected to the supply voltage $V_{CC}$ by line 48. The emitter of transistor $Q_1'$ is connected to one terminal of resistor $R_3$ by line 50. The other terminal of resistor $R_3$ is connected to one terminal of resistor $R_4$ and the base of transistor $Q_2$ by line 52. The other terminal of resistor $R_4$ is connected to the emitter of transistor $Q_3'$ by line 54. The emitter of transistor $Q_2$ is connected to the base of transistor $Q_3'$ and to one terminal of resistor $R_5'$ by line 56. The other terminal of resistor $R_5'$ is connected to ground by line 58. The emitter of transistor $Q_3'$ is connected to one terminal of resistor $R_2'$ by line 6O. The other terminal of resistor $R_5'$ is connected to ground by line 62.

The reference current $I_R$ generated by this circuit is the current flow through resistor $R_2'$. The current flow through resistor $R_2'$ is the sum of the current flows through (1) a positive or regenerative feedback loop from the collector of transistor $Q_3'$, through transistor $Q_1'$ and resistors $R_3$ and $R_4$, to the emitter of transistor $Q_3'$; and (2) a negative feedback loop from the collector of transistor $Q_3'$, through transistors $Q_1'$, $Q_2$ and $Q_3'$, to the base of transistor $Q_3'$. The voltage drop across the positive feedback loop is the sum of the voltage drops across resistors $R_3$ and $R_4$ and the base-to-emitter junction voltage $V_{BE}$ of transistor $Q_1'$. The voltage drop across resistor $R_4$ is the sum of the base-to-emitter junction voltages $V_{BE}$ of the two emitter follower transistors $Q_2$ and $Q_3'$. The voltage drop across the negative feedback loop is the sum of the base-to-emitter function voltages $V_{BE}$ of transistors $Q_1'$, $Q_2$, and $Q_3'$ and the voltage drop across resistor $R_3$.

The reference current $I_R$ can be made to be independent of temperature variations, and to other variations in the base-to-emitter junction voltages $V_{BE}$ of the transistors, by matching the magnitudes of the current flows through the negative and positive feedback loops. This is accomplished by properly proportioning the resistance values of several resistors in the generator circuit. As will be shown, the reference current $I_R$ becomes independent of the base-to-emitter junction voltages $V_{BE}$ when $R_1'=R_3+1.5*R_4$. The two resistors $R_3$ and $R_4$ are a temperature tracking voltage divider connected across emitter follower transistor $Q_3'$, with the junction of the voltage divider applied to the base of emitter follower transistor $Q_2$. If the current source transistor $Q_{CS}$ of the CML circuit is driven by this reference current generator circuit, the output voltage $V_O$ of the CML circuit also becomes temperature independent. This is because the output voltage $V_O$ of the CML circuit is proportional to the collector current $I_O$ of the current source transistor $Q_{CS}$, which is proportional to the reference current $I_R$.

An expression for the reference current $I_R$ generated by reference current generator circuit 40 can be derived as follows, assuming the bipolar transistors have the same current density and the base currents of the transistors are negligible.

$$I_R = I_{R1'} + I_{R3,4}$$

where $I_{R1'}$ = current through resistor $R_1'$ $I_{R3,4}$ = current through resistors $R_3$ and $R_4$ $$= V_{R1'}/R_1' + 2V_{BE}/R_4$$

where $V_{R1'}$ = voltage drop across resistor $R_1'$ $V_{BE}$ = voltage of the base-to-emitter junction of the transistors $$= (V_{CC} - V_{CBQ3'} - V_{BE} - V_{R2'})/R_1' + 2V_{BE}/R_4$$

where $V_{CC}$ = supply voltage $V_{CBQ3'}$ = voltage of the collector-to-base junction of transistor $Q_3'$ $V_{R2'}$ = voltage drop across resistor $R_2'$ $$= (V_{CC} - I_{R3,4}*(R_3 + R_4) - V_{BE} - I_R*R_2')/R_1' + 2V_{BE}/R_4$$

$$= (V_{CC} - 2V_{BE}*((R_3 + R_4)/R_4) - V_{BE} - I_R*R_2')/R_1' + 2V_{BE}/R_4$$

$$I_R*R_1' = V_{CC} - 2V_{BE}*((R_3 + R_4)/R_4) - V_{BE} - I_R*R_2' + 2V_{BE}*R_1'/R_4$$

$$I_R*(R_1' + R_2') = V_{CC} - 2V_{BE}*((R_3 + R_4)/R_4) - V_{BE} + 2V_{BE}*R_1'/R_4$$

-continued $$= V_{CC} - 2V_{BE}*((R_3 + R_4)/R_4) - V_{BE}*R_4/R_4 + 2V_{BE}*R_1'/R_4$$

$$I_R = (V_{CC} - 2V_{BE}*((R_3 + R_4 + 0.5*R_4 - R_1')/R_4))/(R_1' + R_2')$$

$$= (V_{CC} - 2V_{BE}*((R_3 + 1.5*R_4 - R_1')/R_4))/(R_1' + R_2')$$

When $R_3+1.5*R_4$ is set equal to $R_1'$, the $V_{BE}$ term drops out of the last equation and the reference current $I_R$ generated by the reference current generator circuit 4O becomes independent of the base-to-emitter junction voltages $V_{BE}$ of the transistors in the circuit. The expression for the reference current $I_R$ then becomes $$I_R=V_{CC}/(R_1'+R_2').$$

The reference current generator circuit 40 drives the current source transistor $Q_{CS}$ in the CML circuit 30. The base of transistor $Q_3'$ is connected to the base of the current source transistor $Q_{CS}$ by line 32. An expression for the collector current $I_O$ of the current source transistor $Q_{CS}$ and the output voltage $V_O$ of the CML circuit 30 can be derived as follows.

$$I_O=I_R*R_2'/R_E$$

$$V_O=I_O*R_C=I_R*R_2'*R_C/R_E$$

If $R_3+2.5*R_4=R_1'$, then $$I_O=V_{CC}*R_2'/(R_1'+R_2')*R_E$$

$$V_O=V_{CC}*R_2'*R_C/(R_1'+R_2')*R_E.$$

Both the collector current $I_O$ and the CML output voltage $V_O$ are independent of the temperature-varying base-to-emitter junction voltages $V_{BE}$ of the transistors in the two circuits.

In another presently preferred embodiment of the invention, the reference current generator circuit 40 is connected as shown in FIG. 2 to a current source transistor, such as current source transistor $Q_{CS}$, but without the CML logic gate transistors $Q_{CML}$ and the collector resistors $R_C$. The constant current source generates an output current $I_O$ that is independent of the variations in the base-to-emitter junction voltages of the transistors in the circuit, thus providing a constant and stable current source that can be utilized in a variety of electronic circuit applications.

From the foregoing, it will be appreciated that the present invention produces a reference current that nearly eliminates the temperature dependency of the output voltage of a CML circuit and, when combined with a current source transistor, provides a stable and constant current source. Although several preferred embodiments of the invention have been shown and described, it will be apparent that other adaptations and modifications can be made without departing from the spirit and scope of the invention. Accordingly, the invention is not to be limited, except as by the following claims.

I claim:

1. A reference current generator circuit, comprising:

a first transistor having a collector terminal connected to a supply voltage;

a first resistor having one terminal connected to the emitter terminal of the first transistor;

a second resistor;

a second transistor having a collector terminal connected to the supply voltage and having a base terminal connected to the other terminal of the first resistor and connected to one terminal of the second resistor;

a third resistor having one terminal connected to the supply voltage;

a fourth resistor having one terminal connected to ground;

a fifth resistor having one terminal connected to ground; and a third transistor having a collector terminal connected to the base terminal of the first transistor and connected to the other terminal of the third resistor, and having a base terminal connected to the emitter terminal of the second transistor and connected to the other terminal of the fourth resistor, and having an emitter terminal connected to the other terminal of the second resistor and connected to the other terminal of the fifth resistor;

wherein the reference current output by the circuit is the current flow through the fifth resistor

2. The reference current generator circuit as set forth in claim 1, wherein the sum of the resistance value of the first resistor and approximately 1.5 times the resistance value of the second resistor is substantially equal to the resistance value of the third resistor.

3. The reference current generator circuit as set forth in claim 1, and further including:

a current source transistor having a base terminal connected to the base terminal of the third transistor; and an emitter resistor having one terminal connected to the emitter terminal of the current source transistor and the other terminal connected to ground;

whereby the collector current of the current source transistor is constant and stable.

4. The reference current generator circuit as set forth in claim 3, wherein the sum of the resistance value of the first resistor and approximately 1.5 times the resistance value of the second resistor is substantially equal to the resistance value of the third resistor.

5. The reference current generator circuit as set forth in claim 3, and further including a current mode logic (CML) circuit, wherein the CML circuit is driven by the collector current of the current source transistor.

6. The reference current generator circuit as set forth in claim 5, wherein the CML circuit includes:

a pair of logic gate transistors, each logic gate transistor having an emitter terminal connected to the collector terminal of the current source transistor; and a pair of collector resistors, each collector resistor having one terminal connected to the supply voltage and the other terminal connected to the collector terminal of a logic gate transistor;

whereby the voltage drops across the collector resistors are nearly independent of temperature.

7. The reference current generator circuit as set forth in claim 6, wherein the sum of the resistance value of the first resistor and approximately 1.5 times the resistance value of the second resistor is substantially equal to the resistance value of the third resistor.

8. A reference current generator circuit, comprising:

a first emitter follower transistor; a second emitter follower transistor having a base terminal connected to the emitter terminal of the first emitter follower transistor;

a voltage divider connected across the collector and emitter terminals of the second emitter follower transistor, the junction terminal of the voltage divider being connected to the base terminal of the first emitter follower transistor; and a resistor having one terminal connected to the emitter terminal of the second emitter follower transistor and the other terminal connected to ground;

wherein the voltages across the voltage divider are proportioned to provide a reference current flow through the resistor that is independent of variations in the base-to-emitter junction voltages of the transistors.

9. The reference current generator circuit as set forth in claim 8, and further including:

a current source transistor having a base terminal connected to the base terminal of the second emitter follower transistor; and an emitter resistor having one terminal connected to the emitter terminal of the current source transistor and the other terminal connected to ground;

whereby the collector current of the current source transistor is constant and stable.

10. The reference current generator circuit as set forth in claim 9, and further including a current mode logic (CML) circuit, wherein the CML circuit is driven by the collector current of the current source transistor.

11. The reference current generator circuit as set forth in claim 10, wherein the CML circuit includes:

a pair of logic gate transistors, each logic gate transistor having an emitter terminal connected to the collector terminal of the current source transistor; and a pair of collector resistors, each collector resistor having one terminal connected to the supply voltage and the other terminal connected to the collector terminal of a logic gate transistor;

whereby the voltage drops across the collector resistors are nearly independent of temperature.

12. A reference current generator circuit, comprising:

a bipolar transistor;

a positive feedback loop from the collector terminal of the transistor to the emitter terminal of the transistor;

a negative feedback loop from the collector terminal of the transistor to the base terminal of the transistor; and a resistor having one terminal connected to the emitter terminal of the transistor and the other terminal connected to ground;

wherein the magnitudes of the current flows through the negative and positive feedback loops are matched to provide a reference current flow through the resistor that is independent of variations in the base-to-emitter junction voltage of the transistor.

13. The reference current generator circuit as set forth in claim 12, and further including:

a current source transistor having a base terminal connected to the base terminal of the bipolar transistor; and an emitter resistor having one terminal connected to the emitter terminal of the current source transistor and the other terminal connected to ground;

whereby the collector current of the current source transistor is constant and stable.

14. The reference current generator circuit as set forth in claim 13, and further including a current mode logic (CML) circuit, wherein the CML circuit is driven by the collector current of the current source transistor.

15. The reference current generator circuit as set forth in claim 14, wherein the CML circuit includes:

a pair of logic gate transistors, each logic gate transistor having an emitter terminal connected to the collector terminal of the current source transistor; and a pair of collector resistors, each collector resistor having one terminal connected to the supply voltage and the other terminal connected to the collector terminal of a logic gate transistor;

whereby the voltage drops across the collector resistors are nearly independent of temperature.

* * * * *